US007635047B2

(12) United States Patent
Bordewijk

(10) Patent No.: US 7,635,047 B2
(45) Date of Patent: Dec. 22, 2009

(54) HEARING AID

(75) Inventor: Lourens George Bordewijk, Den Haag (NL)

(73) Assignee: Koninklijke Philips Electronics N.V., Eindhoven (NL)

( * ) Notice: Subject to any disclaimer, the term of this patent is extended or adjusted under 35 U.S.C. 154(b) by 149 days.

(21) Appl. No.: 10/500,836

(22) PCT Filed: Jan. 15, 2003

(86) PCT No.: PCT/NL03/00023

§ 371 (c)(1),
(2), (4) Date: Jul. 7, 2004

(87) PCT Pub. No.: WO03/061341

PCT Pub. Date: Jul. 24, 2003

(65) Prior Publication Data

US 2005/0082109 A1 Apr. 21, 2005

(30) Foreign Application Priority Data

Jan. 15, 2002 (NL) ..... 1019747

(51) Int. Cl.
*H04R 25/02* (2006.01)

(52) U.S. Cl. ..... 181/135; 181/129; 381/322; 381/324; 381/328

(58) Field of Classification Search ..... 181/129, 181/130, 135, 128; 381/323, 322, 328, 324
See application file for complete search history.

(56) References Cited

U.S. PATENT DOCUMENTS

| | | | | | |
|---|---|---|---|---|---|
| 4,375,016 | A | * | 2/1983 | Harada | 181/135 |
| 4,532,649 | A | * | 7/1985 | Bellafiore | 381/324 |
| 4,716,985 | A | * | 1/1988 | Haertl | 181/130 |
| 4,852,177 | A | * | 7/1989 | Ambrose | 381/338 |
| 4,870,688 | A | * | 9/1989 | Voroba et al. | 381/60 |
| 5,298,692 | A | * | 3/1994 | Ikeda et al. | 181/135 |
| 5,748,743 | A | * | 5/1998 | Weeks | 381/328 |
| 6,009,183 | A | * | 12/1999 | Taenzer et al. | 381/330 |
| 6,144,750 | A | * | 11/2000 | Levin | 381/328 |
| 6,228,020 | B1 | * | 5/2001 | Juneau et al. | 600/25 |

FOREIGN PATENT DOCUMENTS

| | | |
|---|---|---|
| DE | 0 517 322 | 12/1992 |
| WO | 99/13586 | 3/1999 |
| WO | 00/42817 | 7/2000 |
| WO | 01/41503 | 6/2001 |

* cited by examiner

*Primary Examiner*—Jeffrey Donels
*Assistant Examiner*—Jeremy Luks

(57) ABSTRACT

A hearing aid to be placed in the auditory canal. This hearing aid is composed of one side that is fitted near the outside of the ear and another side that has to be fitted facing the eardrum. The two sides are connected to each other by way of a curvature. This curvature is such that the hearing aid can be used either on the left or on the right by further special measures such as central positioning of the microphone input in the head end face of the one side, making use of only two angles of curvature of approximately 15° and approximately 45°, and using switching means. In this way it is possible to provide a hearing aid that can be used either on the left or on the right.

18 Claims, 1 Drawing Sheet

HEARING AID

BACKGROUND OF THE INVENTION

The present invention relates to a hearing aid to be placed in the auditory canal, comprising a housing provided with a microphone, an amplifier, a loudspeaker and a battery compartment, said housing being provided on one side with means for removing said hearing aid from the ear, and is provided on the other side with sound transmission means for the transmission of sound from said loudspeaker into the auditory organ.

DESCRIPTION OF THE RELATED ART

Such a CIC (completely in channel) hearing aid is known from PCT Application WO 99/13686 in the name of L. G. Bordewijk. Such a device must be distinguished from more conventional hearing aids, which are fitted in or near the pinna of the person concerned.

Fitting the device at a deeper level in the auditory canal has not only optical advantages, but also acoustic advantages.

PCT Application WO 01/41503 also discloses a hearing aid for fitting in the auditory canal, which hearing aid is composed of two parts, the first part being a standard part provided with a relatively rigid plastic standard housing, in which microphone, amplifier, loudspeaker and battery compartments are accommodated. The second part, made of a more flexible plastic material, is adapted to the specific auditory canal of the individual patient.

Until now different hearing aids have been used for the left and right ear, and it was found that neither of these hearing aids was a totally satisfactory fit.

SUMMARY OF THE INVENTION

It is the object of the present invention to avoid these disadvantages and provide a hearing aid that can be used on either side.

This object is achieved in the case of a hearing aid of the type described above by the fact that the head end face of said one side is provided in the center with the input of said microphone.

The hearing aid according to the invention can comprise any type of hearing aid for placing in the auditory canal of a patient. All that is important is that the hearing aid be of a slightly curved design, in order to adapt better to the auditory canal of a patient. According to an advantageous embodiment, the head end face facing outwards is designed in such a way that cosmetically it makes no difference that the standard part in the one ear is in fact rotated 180 degrees relative to the other ear.

The operating elements and their position on said end face are disposed in such a symmetrical arrangement that the 180-degree rotation makes no cosmetic difference to the end result. The microphone input is made in the center, so that the rotation makes no difference whatsoever even to it, and therefore makes no acoustic difference between the one ear and the other. The two other apertures on the end face contain operating elements which do differ, but because of the 180-degree rotation this difference is not noticeable, owing to the fact that these are apertures of exactly the same size that are placed exactly symmetrically.

On the face of it, viewed from the outside, and as a result of the symmetrical arrangement of the end face, the hearing aid on the right will have the same cosmetic profile as the hearing aid on the left. As a result of this design, the fit on the left and on the right, and therefore the positioning in the auditory canal and the appearance of the hearing aid, is the same on both sides of the head, while technically the same hearing aid standard part is still being used on the left and on the right.

According to an advantageous embodiment of the present invention, the hearing aid is composed of a standard part made of a relatively rigid plastic material and a second part that is adapted to the auditory canal of the patient. The rigid plastic part, which provides good protection for the electronic components, according to the present invention is universal, in other words designed for use either on the right or on the left. The more flexible plastic part that is designed to fit the auditory canal of the patient is, of course, dependent upon the auditory canal concerned.

Such constructions must be distinguished from constructions in the case of which a part of the hearing aid is fitted outside the auditory canal. Such a hearing aid is composed of a part that is placed in the ear and is custom-made for the patient concerned, and of a module to be placed on it that is universal. This module can be used either on the left or on the right.

According to an advantageous embodiment, the first central axis provided through said one side and the second central axis provided through said second side form an angle $\alpha$ of at least 10°.

Surprisingly, it has been found that in general two types of hearing aid will suffice. A type by means of which the majority of patients can be helped is one in which the angle between the one side and the other side is approximately 45°. Another type that can be used by certain users is that in which said angle is approximately 15°.

In general, the abovementioned angle lies between 10 and 45°.

Surprisingly, it has found that the hearing aid designed in a reliable way can be used on either the left or the right ear. In other words, a number of components of a hearing aid can be used universally, which considerably reduces the cost.

The hearing aid can be composed of two parts, in other words a universally usable housing and an end piece that is fitted on the other side, in which end piece in particular the sound channel is situated, and which can be adapted to the individual.

According to a further advantageous embodiment, the head end face of the one side, in other words the head end face facing outwards, is provided with an ON/OFF switch of the hearing aid. Furthermore, said head end face is preferably provided with some kind of adjusting means or means that make adjustment possible. These adjusting means can comprise a potentiometer and/or a connection with any software that may be present in the hearing aid.

According to a further advantageous embodiment, the cross section of the hearing aid is preferably oval, and more particularly is elliptical (symmetrically oval).

Furthermore, one part is provided with means for the removal of the hearing aid, which means are preferably manufactured by injection molding. The other side can likewise be provided with such means, which serve as an aid if the hearing aid becomes detached in the auditory canal, or if the first means for the removal should unexpectedly fail.

BRIEF DESCRIPTION OF THE DRAWINGS

The invention will be illustrated below with reference to preferred embodiments. In the drawing.

DESCRIPTION OF THE PREFERRED EMBODIMENTS

Figure 1:
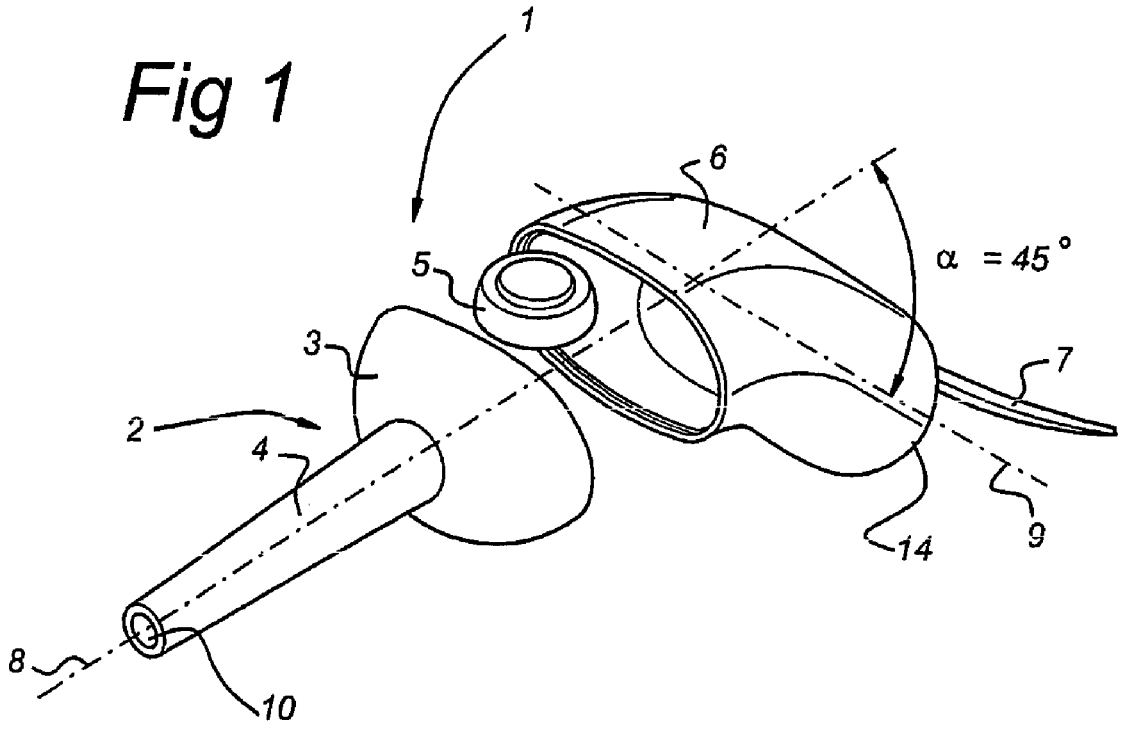
FIG. 1 shows diagrammatically in perspective a first embodiment of the hearing aid according to the invention.

A hearing aid is indicated in its entirety by 1 in FIG. 1. This hearing aid is composed of an internal part 2 and an external part 6, which can also be indicated as a housing. The internal part is composed of a connecting part for connection to the housing 6 and a part 4 adapted to the specific geometry of the auditory canal of the patient concerned. Sound channel 10 is fitted in part 4.

The external part 6 is preferably composed of a rigid plastic housing, in which electronic components are accommodated. According to the present invention, this part is a standard part that can be used for either the left or the right ear. The internal part is designed depending on the present auditory canal of the patient.

A space for battery 5 is bounded between the internal part 2 and the housing 6. Battery 5 is accommodated in a compartment of the housing 6 not shown in any further detail. A microphone, an amplifier (digital or otherwise) and a loudspeaker, which are not illustrated, are also present in housing 6. Connection to the environment is achieved by way of the sound aperture 11. As can be seen from FIG. 2, said aperture is provided in the end face of the housing. The head end face is indicated by 14. Aperture 11 is positioned centrally, in other words whatever the position of the housing 6 is, aperture 11 will always have the same position relative to the pinna of the patient concerned. Reference numeral 7 indicates a pull rod, which is connected to the housing and is made by injection molding. This pull rod is preferably transparent and serves to remove the hearing aid from and/or position it in the auditory canal.

The central axis of the internal part 2, described above by other side, is indicated by 8. This central axis is preferably in a position perpendicular to the end face of the internal part. The longitudinal axis of the housing, indicated above by one part, is indicated by 9. This longitudinal axis is preferably in a position perpendicular to the head end face of the external part of the housing. The angle between said axes is indicated by $\alpha$ and according to the invention is preferably greater than 10°, and lies more particularly either at approximately 15°, or preferably approximately 45°.

Figure 2:
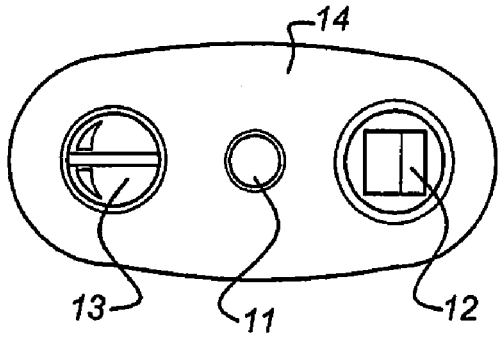
FIG. 2 shows an end view of the hearing aid according to FIG. 1.

It can be seen from FIG. 2 that a switch 12 is also present in the end face 14, for switching on/switching off the hearing aid. An adjusting facility 13 is also present. In the present case this is a connector for connection to a computer or the like for setting the sound characteristics and the sound level of the amplifier fitted in the housing 6. It can be seen from FIG. 2 that the outer boundary is symmetrically oval, and more particularly is elliptical.

As shown in FIG. 2, the construction according to the invention is mirror symmetrical in end view, in other words the same view is achieved on rotation through 180°. The same preferably applies to the remaining part of housing 6. This housing 6 is a universal housing and is dimensioned in such a way that it can be placed in two positions, in other words on the left and on the right, in the smallest auditory canal existing. Part 3 is adapted specifically to the patient concerned and to the auditory canal concerned (left or right). In other words, part 6 will generally be smaller than the available space in the auditory canal, with the result that it is possible to insert the hearing aid according to the invention at a deeper level in the auditory canal than is the case with existing hearing aids. This is because the curved shape of the auditory canal does not constitute any obstruction, owing to the fact that part 6 is made smaller than this canal. In order to make it all function properly, it is, of course, important for the end face to be in a position perpendicular to axis 9. Only in those circumstances can full symmetry be ensured.

Variants that lie within the scope of the appended claims will spring to mind in the case of the person skilled in the art after reading the above.

The invention claimed is:

1. A hearing aid to be placed in the auditory canal of a patient, the hearing aid comprising:

a standard part configured to fit near an outside of an auditory canal of a patient, the standard part comprising a rigid plastic and accommodating a microphone, an amplifier, a loudspeaker and a battery compartment; and a dedicated part configured to fit in the auditory canal, and facing an eardrum, of one of a left ear and a right ear of a patient, the dedicated part being adapted to a specific geometry of the auditory canal of one of the left ear and the right ear of the patient, wherein the dedicated part is provided with sound transmission means for the transmission of sound from said loudspeaker into the auditory canal, the sound transmission means being adapted to the specific geometry of the auditory canal, wherein the standard part has an outer end face, a surface extending across the entirety of said outer end face being symmetrically oval and having a sound aperture at the center of the surface configured to transmit sound to said microphone, and wherein said standard part is configured to connect to said dedicated part regardless of whether said dedicated part is configured to fit in the auditory canal of the left ear or the right ear of the patient.

2. The hearing aid as claimed in claim 1, wherein the outer end face is provided with a switching means and an adjusting means on said surface, the switching means and the adjusting means positioned along a single line bisecting the sound aperture, and the switching means and the adjusting means being positioned on either side of the sound aperture and equidistant from the sound aperture along the single line.

3. The hearing aid as claimed in claim 1, further comprising a means for removing the hearing aid from the auditory canal, the removing means having an injection molded part connected to the standard part.

4. The hearing aid as claimed in claim 1, wherein said dedicated part is provided with a means for removing the dedicated part from the auditory canal.

5. The hearing aid as claimed in claim 1, wherein the standard part is provided with means for removing said hearing aid from the auditory canal.

6. The hearing aid as claimed in claim 1, wherein the dedicated part has a central axis perpendicular to an end face of the dedicated part, the standard part has a longitudinal axis perpendicular to the outer end face, and the central axis and the longitudinal axis form an angle of at least 10 degrees with respect to each other.

7. The hearing aid as claimed in claim 1, wherein a cross section of an outer boundary of the outer end face of the standard part is mirror symmetrical in outside end view.

8. The hearing aid as claimed in claim 6, wherein said angle is at least 15 degrees.

9. The hearing aid as claimed in claim 6, wherein said angle is approximately 45 degrees.

10. The hearing aid as claimed in claim 1, wherein the standard part is configured to connect in a first orientation to the dedicated part configured to fit in the auditory canal of the left ear, wherein the standard part is configured to connect in a second orientation to the dedicated part configured to fit in the auditory canal of the right ear, and wherein the standard part in the second orientation is rotated 180-degrees with respect to the connecting part in the first orientation.

11. The hearing aid as claimed in claim 10, wherein the standard part has a plurality of control apertures in the outer end face symmetrically arranged around the sound aperture and along an axis extending along the surface of the outer end face.

12. A hearing aid, comprising:

a standard part comprised of rigid plastic and an enclosed interior volume housing a microphone, an amplifier, a loudspeaker, and a battery compartment; and a dedicated part shaped to fit in an auditory canal facing an eardrum of a patient, the dedicated part adapted to a specific geometry of the auditory canal of one of a left ear and a right ear of the patient, wherein, the dedicated part is comprised of a sound transmitter for transmitting sound from said loudspeaker into the auditory canal, the sound transmitter adapted to the specific geometry of the auditory canal of one of the left ear and the right ear of the patient, and wherein the sound transmitter extends along a central axis forming an angle of at least ten degrees with respect to a longitudinal axis of the standard part, the standard part is comprised of i) an outer end face, and ii) a microphone sound aperture located in a center of the outer end face, a cross section of an outer boundary of the outer end face of the standard part is mirror symmetrical in outside end view, the longitudinal axis is perpendicular to the outer end face of the standard part, and the standard part is configured to connect to the dedicated part regardless of whether the dedicated part is adapted to the auditory canal of the left ear or the right ear of the patient.

13. A hearing aid, comprising:

a dedicated part, having an end face and an exterior surface, and containing only a sound channel configured to function as a sound transmitter, the exterior surface of the dedicated part configured to fit with a specific geometry of an auditory canal of one of a left ear and a right ear; and a standard part enclosing electronics and a battery, the standard part comprised of an outer end face, a microphone sound aperture located at a center of the outer end face, and a connecting part connecting the standard part to the dedicated part, wherein the dedicated part has a central axis, perpendicular to the end face of the dedicated part, forming an angle of at least ten degrees with respect to a longitudinal axis, perpendicular to the outer end face of the standard part, wherein the standard part is mirror symmetrical in an end view and control elements are provided on the outer end face of the standard part and disposed in a symmetrical arrangement around the microphone sound aperture, and wherein the connecting part is configured to connect to the dedicated part regardless of whether the dedicated part is configured to fit with the specific geometry of the auditory canal of the left ear or the right ear.

14. The hearing aid as claimed in claim 13, wherein, the dedicated part is an internal part and the standard part is an external part.

15. The hearing aid as claimed in claim 13, wherein, the dedicated part is an internal part and the standard part is an external part, and the standard part accommodates each of the electronics and a battery, the electronics comprising a microphone, an amplifier, and a loudspeaker within an enclosed volume.

16. The hearing aid of claim 13, further comprising:

a pull rod connected to a housing of the standard part, the pull rod configured to remove the hearing aid from the auditory canal.

17. The hearing aid as claimed in claim 13, wherein the control elements on the outer end face include a switch and an adjusting facility, the microphone sound aperture located directly between the switch and the adjusting facility.

18. The hearing aid as claimed in claim 13, wherein the connecting part is configured to connect in a first orientation to the dedicated part with the exterior surface configured to fit with the specific geometry of the auditory canal of the left ear, wherein the connecting part is configured to connect in a second orientation to the dedicated part with the exterior surface configured to fit with the specific geometry of the auditory canal of the right ear, and wherein the connecting part in the second orientation is rotated 180-degrees with respect to the connecting part in the first orientation.

* * * * *